US006460604B1

(12) United States Patent
Damm et al.

(10) Patent No.: US 6,460,604 B1
(45) Date of Patent: Oct. 8, 2002

(54) APPARATUS FOR UPHILL LOW PRESSURE CASTING OF MOLTEN METAL

(75) Inventors: Norbert Damm, Schaffhausen; Herbert Zulauf, Feuerthalen, both of (CH)

(73) Assignee: Georg Fischer DISA AG, Schaffhausen (CH)

( * ) Notice: Subject to any disclaimer, the term of this patent is extended or adjusted under 35 U.S.C. 154(b) by 0 days.

(21) Appl. No.: 09/410,630

(22) Filed: Oct. 4, 1999

(30) Foreign Application Priority Data

Oct. 2, 1998 (DE) ..... 198 45 389

(51) Int. Cl.[7] ..... B22D 17/06

(52) U.S. Cl. ..... 164/306; 164/337; 164/319; 164/321

(58) Field of Search ..... 164/306, 337, 164/309, 319, 321, 119, 120

(56) References Cited

U.S. PATENT DOCUMENTS

| | | | | |
|---|---|---|---|---|
| 4,153,100 A | * | 5/1979 | Balevski et al. | 164/306 |
| 4,365,944 A | * | 12/1982 | Pajonk et al. | 425/7 |
| 5,271,539 A | | 12/1993 | Ozawa et al. | 222/595 |

FOREIGN PATENT DOCUMENTS

| | | | |
|---|---|---|---|
| DE | 2648730 | 10/1976 | B22D/18/04 |
| DE | 3024709 | 6/1980 | B22D/41/12 |
| DE | 8230594 | 10/1982 | B22D/41/12 |
| DE | 0128280 | 3/1984 | B22D/27/00 |
| DE | 4116998 | 5/1991 | B22D/18/04 |
| DE | 4139743 | 12/1991 | B22D/39/06 |
| DE | 4203193 | 2/1992 | B22D/21/04 |
| DE | 4403285 | 1/1994 | B22D/17/28 |
| DE | 19510381 | 3/1995 | B22D/18/04 |
| DE | 19720057 | 5/1997 | B22D/18/04 |
| EP | 0846509 | 6/1998 | B22D/18/04 |
| FR | 902463 | 8/1945 | |
| FR | 7441674 | 7/1976 | B22D/47/02 |
| GB | 1557972 | 12/1997 | B22D/17/30 |
| JP | 05337627 | 12/1993 | B22D/18/04 |

* cited by examiner

*Primary Examiner*—Tom Dunn
*Assistant Examiner*—I.-H. Lin
(74) *Attorney, Agent, or Firm*—Antonelli, Terry, Stout & Kraus, LLP

(57) ABSTRACT

An apparatus for uphill low pressure casting of molten metal in sand molds conveyed in synchronized manner with a casting station located at the conveyor, a gas pressure holding furnace containing the molten metal and located at the casting station with a rising casting tube connectable to the sand molds has a device for refilling the holding furnace with molten metal. To permit a rapid casting cycle and high casting capacities, the refilling device has at least one pressure-tight melt container and a filling tube located in the holding furnace with a seal positioned outside the same. The melt container is couplable in pressure-tight manner by means of its outlet to the holding furnace filling tube. The holding furnace is connected to the melt container by means of a pneumatic pressure compensating line.

3 Claims, 2 Drawing Sheets

APPARATUS FOR UPHILL LOW PRESSURE CASTING OF MOLTEN METAL

BACKGROUND OF THE INVENTION

1. Field of the Invention

The invention relates to an apparatus for the uphill low pressure casting of molten metal in sand moulds conveyed in a synchronized manner with a casting station located on the conveyor, a molten metal-containing gas pressure holding furnace located at the casting station and having an uphill casting tube connectable to the sand moulds and a device for refilling the holding furnace with molten metal.

2. Description of the Prior Art

Uphill low pressure casting is widely used, particularly for light metals, preferably aluminium. The reason for this is that light metal melts very rapidly oxidize in air and undesired oxide skin is formed, which significantly impairs the quality of the casting. Thus, closed casting paths must be ensured. Where air contact is unavoidable, namely in the mould, turbulent movements of the melt must be avoided. This only takes place in a satisfactory manner using the uphill casting principle, in which the melt is forced out of a holding furnace under gas pressure into the mould. This casting principle is particularly advantageous if, as is increasingly the case, sand moulds are used, because as a result of the non-turbulent or only slightly turbulent melt flow the detachment of sand particles in the mould is avoided, which would give rise to quality losses on the finished casting.

Casting in sand moulds known from iron and steel casting foundries is nowadays possible with high cycle times because, as opposed to die casting, the sand moulds only have to be stopped at the casting station for the time necessary for filling the mould, whilst the overall cooling process and the solidification of the casting can take place on a following cooling section. There are also limits with respect to die casting with increasing casting weight. Conversely with low pressure casting problems arise in that the conventional gas pressure holding furnaces, which can only contain a specific melt quantity, fail with high casting capacities of several tonnes per hour and even with lower casting capacities, but high cycle times for the refilling of the melt require too much time. During refilling the mould conveying must also be stopped.

In the case of downhill low pressure casting the refilling of the melt container takes place more or less continuously by means of an upstream melting pot with a dip pipe introduced into the holding furnace. This would lead in the case of uphill casting, in which the mould to be filled is above the holding furnace, to a geodesic height of the pot, which would be associated with a considerable height of fall of the melt. Thus, once again there is an increase in oxide formation risks and the gas quantity absorbed by the melt rises, which would in turn significantly impair the casting quality.

SUMMARY OF THE INVENTION

The invention provides an apparatus for uphill low pressure casting, which on the one hand makes it possible to maintain high cycle times in the conveyor of the sand moulds and on the other permits a high casting capacity (To/h).

On the basis of the aforementioned apparatus, this problems of the prior art are solved in that the device for refilling has at least one pressure-tight melt container with a melt supply and a bottom outlet and a filling tube located in the holding furnace with a seal positioned outside the same, that the melt container by means of its outlet can be coupled in pressure-tight manner to the holding furnace filling tube and that the holding furnace is connected to the melt container by means of a pneumatic pressure compensating line.

According to the invention on the holding furnace is placed a refilling container, which contains a melt supply and by means of a fill tube dipping into the holding furnace transfers the melt to the holding furnace. The transfer of the melt from the refilling container into the holding furnace is possible without any additional lowering of the gas pressure in the holding furnace in that the latter is connected to the refilling container by means of a pneumatic pressure compensating line, which link the gas cushion in the holding furnace and in the refilling container. Thus, for the same reason, the coupling between the outlet of the melt container and the holding furnace filling tube is pressure-tight.

The sealing of the filling tube is preferably controllable as a function of the conveying cycle of the sand moulds.

The control can take place in such a way that following each casting cycle the seal is opened for sufficiently long to permit the refilling of the melt volume necessary for filling the sand mould. However, the refilling cycles can also be longer and then with each refilling cycle a larger melt volume can be transferred into the holding furnace. With this operation in a pressure-compensated state, the filling dynamics during the refilling of the melt is limited to the metallostatic pressure difference, because the gas pressure in the furnace changing during the casting cycle by means of the pressure compensating line being always also present at the melt level in the refilling container, so that the gas pressure in the holding furnace is completely compensated. Unlike in the case of filling by means of pots with the same geodesic height, in the case of the apparatus constructed according to the invention the melt is transferred into the furnace in a closed system and then the melt can continuously overflow without any air suction. The flow rate in the filling tube can be reduced to the desired level by adopting known measures.

Advantageously the filling tube ends close to the bottom of the holding furnace, so that also in the tatter there are no turbulent melt movements during the refilling cycle.

In another advantageous development the filling tube is cardan-mounted in the holding furnace in order to facilitate the coupling of the bottom outlet of the melt container to the furnace.

A preferred variant of the invention uses the melt container constructed as a transportation container with a seal at the bottom outlet and is replaceable by a full transportation container after emptying.

The seals at the bottom outlet and at the filling tube must be closed for replacement purposes. The pressure compensating line must also be detached from the container and the latter is then decoupled and replaced by a full melt container. The latter is coupled in the vicinity of the seals to the filling tube, the pressure compensating line is connected and operation can then commence. Replacement can also take place during casting, so that the sand moulds can still be cast with the given time cycle.

It is advantageous if, prior to the coupling to the filling tube and the connection of the pressure compensating line, the transportation container is pretensioned with gas pressure, so that a pressure drop in the holding furnace is avoided on coupling and it is possible to start the refilling from the melt container immediately after coupling.

The transportation container is preferably placed in a transportation support by means of which it is insertable in receptacles on the holding furnace.

This ensures a simple, rapid positioning of the refilling container in the coupling position on the holding furnace, so that limited time is needed for the replacement process and in conjunction with the aforementioned features any air access to the melt system is prevented. Alignment errors in the coupling position can be easily compensated by the cardan mounting of the filling tube on the holding furnace.

For high casting capacities of up to several tonnes per hour, in general a larger stationary melt supply will be kept available, e.g. in a fore-hearth or in a treatment furnace, because with such casting capacities the replacement of the refilling container can no longer take place sufficiently quickly or is complicated and costly as a result of the then necessary frequent replacement. According to the invention, for such a case the melt container is placed as a lock container between the holding furnace and the stationary melting plant or stationary melt supply and can be refilled by means of a dip pipe with a front side seal outside the melt container.

Refilling can take place by means of an open pot coupled by means of the seal to the dip pipe, so that once again the lock container and holding furnace can be operated as a pressure-tight system with overpressure. During refilling cycles the lock container is briefly pressure-relieved and following the transfer of the melt into the lock container the latter is placed under pressure again.

BRIEF DESCRIPTION OF THE DRAWINGS

The invention is described in greater detail hereinafter relative to embodiments and the attached drawings, wherein show.

DESCRIPTION OF THE PREFERRED EMBODIMENTS OF THE INVENTION

Figure 1:
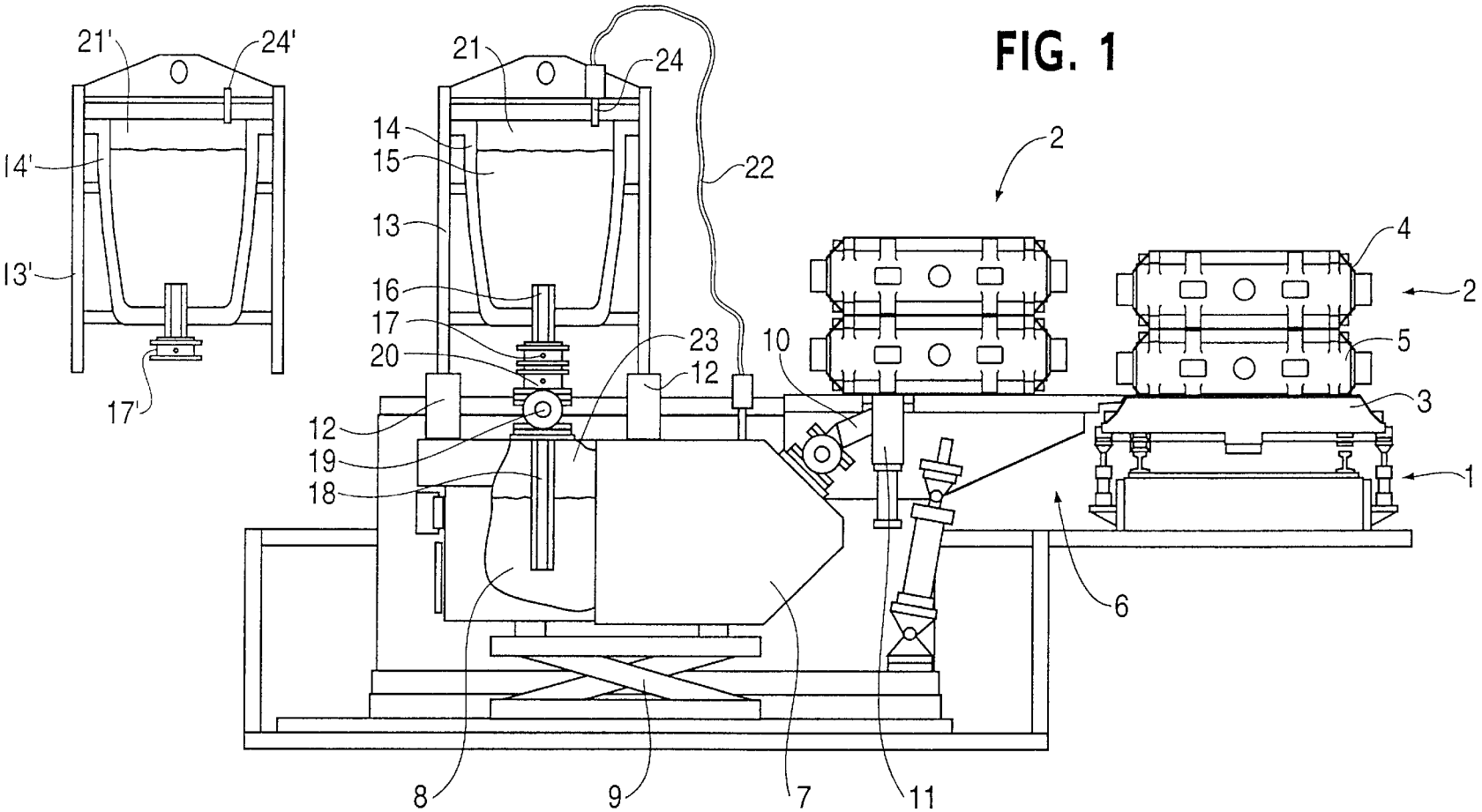
FIG. 1 A diagrammatic view of the apparatus in a first embodiment.
Figure 2:
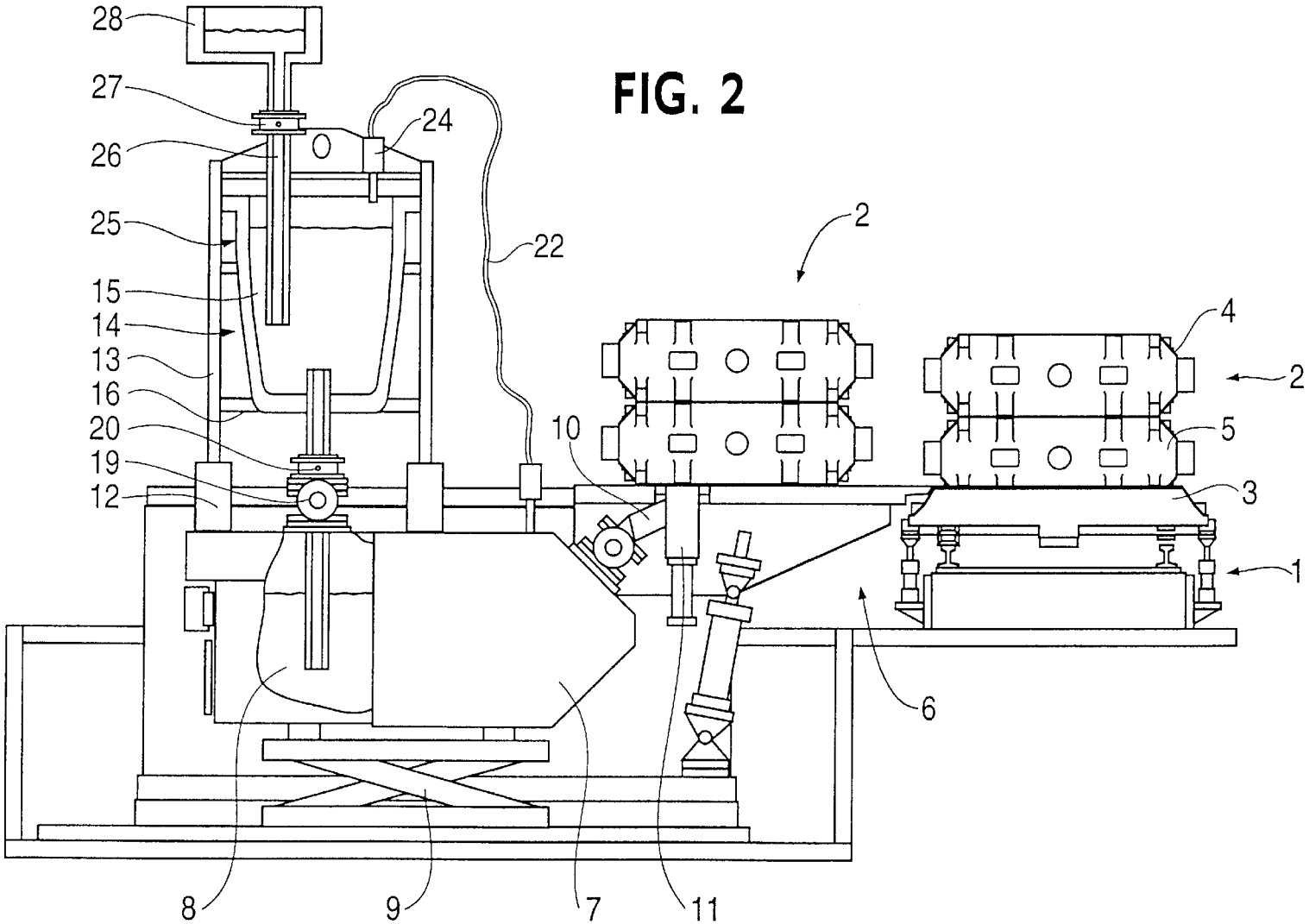
FIG. 2 A view similar to FIG. 1 of a second embodiment.

FIGS. 1 and 2 show a conveyor 1, e.g. in the form of a roller conveyor, on which the sand moulds 2 are conveyed by means of pallets 3 from the mould row into the casting station. In the embodiment shown these are box-connected sand moulds 2, which consequently comprise upper boxes 4 and lower boxes 5. In the embodiment shown a mould frame 6 is located at the casting station and on it the sand moulds 2 are raised from the conveyor 1. Instead of this casting can naturally also take place in the conveyor 1.

At the casting station a holding furnace 7 is located below and alongside the mould frame 6, contains the melt 8 and is raisable and lowerable, e.g. by means of a shear lifting table 9. Optionally the shear lifting table 9 or holding furnace 7 on the latter can additionally be moved in translatory manner.

On its one side the holding furnace 7 has a casting tube 10, positioned in rising manner and which is immersed in the melt 8 in the holding furnace 7. The riser issues by means of a seal at the surface of the mould frame 6, where the sand mould 2, namely the lower box 5, is positionable with its sprue.

At the holding furnace 7 is provided a receptacle 12 for a transportation support 13, which receives a pressure-tight melt container 14. In this embodiment the melt container 14 fulfils the function of a transportation container, which contains a melt supply 15, which can run out by means of a bottom outlet 16. The bottom outlet 16 is equipped with a seal 17, by means of which it is connectable to a filling tube 18 immersed in the melt 8 of the holding furnace 7. At 19 the filling tube 18 is cardan-mounted (universal joint) on the holding furnace 7 and also provided with a controllable seal 2,0, which is controllable as a function of the conveying cycle in the conveyor 1.

The pressure-tight melt container 14, namely its gas pressure cushion 21 is connectable by means of a pressure compensating line 22 to the gas pressure cushion 23 of the holding furnace 7. In the vicinity of its connections to the melt container 14 and the holding furnace 7, the pressure compensating line 22 is provided with suitable controllable seals. A further seal is located on the top of the melt container 14.

FIG. 1 shows a further transportation support 13' with a melt container 14'. This arrangement is constructed in the same way as that described herein-before. The seal 17' of the melt container 14' is in the closed position. The melt container 14' is also pretensioned by pressurized gas by means of the sealable connection 24', so that in the space 21 ' there is roughly the same pressure as in the gas cushion 21 in the melt container 24 in the refilling position.

Operation takes place as follows: After positioning the sand mould 2 in the casting position, the seal 11 is opened and the melt, under the pressure of the gas cushion 23 in the holding furnace 7, penetrates through the riser 10 into the sand mould 2 until the mould cavity is filled. The seal 11 is then brought into the closed position and the sand mould 2 is returned to the conveyor 1 and is advanced thereon by one position and the next sand mould is brought into the casting position. For each casting cycle or after several casting cycles, the seals 17 and 20 are controlled and the melt 15 can be transferred from the melt container 14, via the bottom outlet 16 and filling tube 18 into the holding furnace 7. This preferably takes place between two casting cycles, so as not to influence the casting process by the filling dynamics. The pressure compensating line 22 ensures that the filling dynamics are not additionally influenced by the pressure differences. The outflow rate of the melt 15 through the bottom outlet 16 and filling tube 18 can be kept low by suitable cross-sections and fittings.

When the melt container 14 has been emptied, with the seal 17 closed, the container is decoupled from the closed seal 20 and the pressure compensating line 22 or the corresponding seal 24 on the melt container 14 is closed. The melt container 14 can now be removed by means of the transportation support 13 from the receptacles 12 and replaced by the melt container 14'. When the latter is in position, it is coupled by its seal 17' to the seal 20 of the filling tube 18, then the pressure compensating line 22 is connected and the seal 24' at the melt container 14' is opened. Refilling of the holding furnace 7 then takes place in the above-described manner.

FIG. 2 shows a modified construction, the same components being given the same reference numerals. In this case the melt container 14 is constructed as a stationary lock container 25, whose bottom outlet 16 is coupled to the seal 20 of the filling tube 18. The pressure-tight lock container 25 is once again connected by means of the pressure compensating line 22 to the holding furnace 7. In the lock container 25 is inserted a dip pipe 26, which is provided at the top and outside the lock container 25 with a seal 27. To the lock container 25 is coupled a pot 28, which is filled from a stationary melt supply. It can be a forehearth, treatment furnace or the like.

The refilling of the holding furnace 7 once again takes place by means of the controllable seal 20 and the filling tube 18 in the above-described manner. The top seal 27 of the lock container 25 is closed. Between these refilling cycles the lock container 25 can be refilling by means of the pot 28. For this purpose the pressure in the lock container 25 is relieved to such an extent that the geodesic height between the pot 28 and the remaining melt level in the lock container 25 is sufficient to permit the overflow of melt from the pot 28. Following this refilling process the seal 27 is returned to the closed position and pressure compensation is restored by means of the line 22 between lock container 25 and holding furnace 7.

What is claimed is:

1. An apparatus for uphill low pressure casting of molten metal in sand moulds conveyed synchronously comprising:

a casting station located at a conveyor;

a gas pressure holding furnace containing the molten metal, located at the casting station and including a rising casting tube connectable to the sand moulds; and a device for refilling the holding furnace with molten metal including at least one pressure-tight melt container which is moveable relative to the casting station and is replaceable with another pressure-tight container; a filling tube located in the holding furnace with a seal located outside the filling tube with the melt container being selectively connectable in a pressure-tight manner by a bottom outlet to the filling tube of the holding furnace, the holding furnace being connected to the melt container by a pneumatic pressure compensating line to prevent a pressure difference between the holding furnace and the melt container to avoid influence of the casting processing during the flow of molten metal into the holding furnace; and wherein the seal located outside the filling tube is controllable as a function of a conveying cycle of the same moulds, the filling tube terminates in proximity to a bottom in the holding furnace, the filling tube is mounted on the holding furnace by a cardan mount, and the melt container includes a seal at the bottom outlet and is pretensioned with pressurized gas prior to coupling to the filling tube and connection to the pneumatic pressure compensating line.

2. An apparatus according to claim 1, wherein the at least one pressure-tight melt container is located in a transportation support and is inserted in receptacles on the holding furnace.

3. An apparatus according to claim 1, wherein the melt container is a lock container placed between the holding furnace and a stationary supply of molten metal and is refillable by a dip pipe with a top seal outside the lock container.

* * * * *